US009695823B2

(12) United States Patent
Berning

(10) Patent No.: US 9,695,823 B2
(45) Date of Patent: Jul. 4, 2017

(54) COMPRESSOR WITH UNLOADER COUNTERWEIGHT ASSEMBLY

(71) Applicant: Emerson Climate Technologies, Inc., Sidney, OH (US)

(72) Inventor: Jeff Berning, Fort Loramie, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 361 days.

(21) Appl. No.: 14/514,439

(22) Filed: Oct. 15, 2014

(65) Prior Publication Data

US 2015/0118089 A1 Apr. 30, 2015

Related U.S. Application Data

(60) Provisional application No. 61/898,212, filed on Oct. 31, 2013.

(51) Int. Cl.

| | |
|---|---|
| ***F04C 18/04*** | (2006.01) |
| ***F04C 29/00*** | (2006.01) |
| ***F04C 18/02*** | (2006.01) |

(52) U.S. Cl.

CPC ..... *F04C 29/0021* (2013.01); *F04C 18/0215* (2013.01); *F04C 29/0057* (2013.01); *F04C 2240/807* (2013.01)

(58) Field of Classification Search

CPC ..... F01C 19/02; F01C 19/04; F01C 19/08; F01C 19/10; F01C 1/18; F04C 2/126; F04C 2240/807

USPC ..... 418/55.1

See application file for complete search history.

(56) References Cited

U.S. PATENT DOCUMENTS 8,231,367 B2 7/2012 Suefuji et al.

FOREIGN PATENT DOCUMENTS

| | | | |
|---|---|---|---|
| CN | 101469703 | A | 7/2009 |
| CN | 201610844 | U | 10/2010 |
| CN | 204327492 | U | 5/2015 |
| JP | H03-260386 | A | 11/1991 |
| JP | H04-175486 | A | 6/1992 |
| JP | H10-54379 | A | 2/1998 |

(Continued)

OTHER PUBLICATIONS

WO 2012117600 A1 filed Jul. 9, 2012 attached with English Translation and English Translation of JP 2005307948 Attached no date given.*

(Continued)

*Primary Examiner* — Mark Laurenzi
*Assistant Examiner* — Anthony Ayala Delgado
(74) *Attorney, Agent, or Firm* — Harness, Dickey & Pierce, P.L.C.

(57) ABSTRACT

A compressor is provided and may include a shell, an orbiting scroll, a driveshaft and an unloader counterweight. The orbiting scroll may be disposed within the shell and include a boss portion. The driveshaft may include an eccentric pin and rotate about a longitudinal axis. The unloader counterweight assembly may include a first, a second end, and a longitudinal opening extending therebetween. The eccentric pin of the driveshaft may be disposed within the longitudinal opening at the first end of the unloader counterweight assembly. The boss portion of the orbiting scroll may be disposed within the longitudinal opening at the second end of the unloader counterweight assembly.

18 Claims, 3 Drawing Sheets

(56) References Cited

FOREIGN PATENT DOCUMENTS

| | | | | | |
|---|---|---|---|---|---|
| JP | 2005-307948 | A | | 11/2005 | |
| JP | 2005307948 | A | * | 11/2005 | |
| KR | 2010-0058821 | A | | 6/2010 | |
| WO | WO-2012-117600 | A1 | | 9/2012 | |
| WO | WO 2012117600 | A1 | * | 9/2012 | ..... F04C 18/0215 |

OTHER PUBLICATIONS

First Office Action of Chinese application No. 201410601635.7, dated Apr. 1, 2016. Translation provided by Unitalen Attorneys At Law.

Office Action regarding Chinese Patent Application No. 201410601635.7, dated Dec. 21, 2016. Translation provided by Unitalen Attorneys at Law.

* cited by examiner

COMPRESSOR WITH UNLOADER COUNTERWEIGHT ASSEMBLY

CROSS-REFERENCE TO RELATED APPLICATIONS

This application claims the benefit of U.S. Provisional Application No. 61/898,212, filed on Oct. 31, 2013. The entire disclosure of the above application is incorporated herein by reference.

FIELD

The present disclosure relates to a scroll compressor with an unloader counterweight assembly.

BACKGROUND

This section provides background information related to the present disclosure which is not necessarily prior art.

Scroll compressors are used in applications such as refrigeration systems, air conditioning systems, and heat pump systems to pressurize and, thus, circulate refrigerant within each system.

As the scroll compressor operates, an orbiting scroll member having an orbiting scroll member wrap orbits with respect to a non-orbiting scroll member having a non-orbiting scroll member wrap to make moving line contacts between flanks of the respective scroll wraps. In so doing, the orbiting scroll member and the non-orbiting scroll member cooperate to define moving, crescent-shaped pockets of vapor refrigerant. A volume of the fluid pockets decreases as the pockets move toward a center of the scroll members, thereby compressing the vapor refrigerant disposed therein from a suction pressure to a discharge pressure.

Two types of contacts define the fluid pockets formed between the orbiting scroll member and the non-orbiting scroll member, and create forces therebetween. Namely, radial or flank forces are created by axially extending tangential line contacts between spiral faces or flanks of the scroll wraps and axial forces are created by area contacts between the planar edge surfaces, or tips, of each scroll wrap and an opposing end plate of the other scroll member. While such forces are easily managed in a fixed-speed compressor, flank forces can be a source of undesirable fluid leakage and sound that is difficult to manage in a variable-speed compressor. Undesirable sound and frictional efficiency losses are experienced at higher speeds in the variable-speed compressor, particularly in radially compliant variable-speed scroll compressors. Such radially compliant scroll compressors incorporate an unloader bushing for allowing the flanks of the orbiting scroll to disengage the flanks of the non-orbiting scroll while the compressor is not in operation, and allow the flanks of the orbiting and non-orbiting scrolls to engage while in operation. Such radial compliant scroll compressors are described in U.S. Pat. No. 5,295,813.

SUMMARY

This section provides a general summary of the disclosure, and is not a comprehensive disclosure of its full scope or all of its features.

A compressor is provided and may include a shell, an orbiting scroll, a driveshaft and an unloader counterweight. The orbiting scroll may be disposed within the shell and include a boss portion. The driveshaft may include an eccentric pin and rotate about a longitudinal axis. The unloader counterweight assembly may include a first end, a second end, and a longitudinal opening extending therebetween. The eccentric pin of the driveshaft may be disposed within the longitudinal opening at the first end of the unloader counterweight assembly. The boss portion of the orbiting scroll may be disposed within the longitudinal opening at the second end of the unloader counterweight assembly In another aspect of the disclosure, an unloader counterweight is provided and may include a first end, a second end, and a longitudinal opening. The first end may define a first surface. The second end may define a second surface parallel to the first surface. The longitudinal opening may extend between the first surface and the second surface and include at least a substantially flat portion. The unloader counterweight may include a stepped profile from the first end to the second end.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
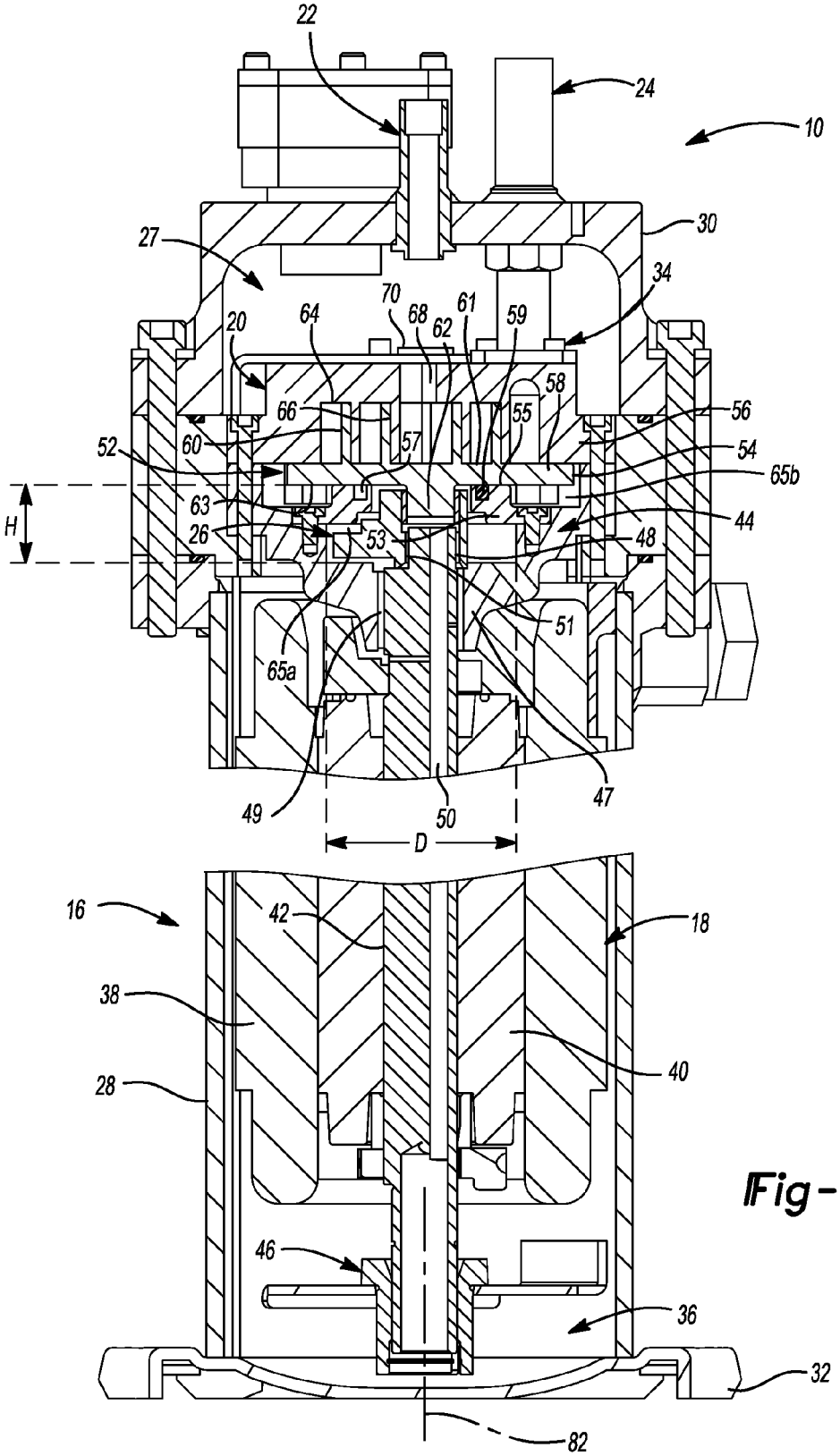
FIG. 1 is a cross-sectional view of a compressor in accordance with the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the Figures, a compressor 10 is shown. The compressor 10 may include a hermetic shell assembly 16, a motor assembly 18, a compression mechanism 20, a discharge fitting 22, a suction inlet fitting 24, and an unloader assembly 26. The shell assembly 16 may define a high-pressure discharge chamber 27 and may include a cylindrical shell 28, an end cap 30 at an upper end thereof, and a base 32 at a lower end thereof. The base 32 of the shell assembly 16 may at least partially define a lubricant sump 36. While the compressor 10 is shown as a high-side compressor, it will be appreciated that the teachings herein can also be applied to a low-side compressor, where the motor assembly 18 is located in a suction pressure chamber.

The discharge fitting 22 may be attached to the end cap 30 and may fluidly communicate with the discharge chamber 27. The suction inlet fitting 24 may be attached to shell assembly 16 and may fluidly communicate with the compression mechanism 20 via a check valve 34 at or proximate an inlet of the compression mechanism 20, while fluidly isolating the low-pressure fluid from the high-pressure fluid in the discharge chamber 27.

The motor assembly 18 may be disposed entirely within the discharge chamber 27 and may include a motor stator 38, a rotor 40, and a driveshaft 42. The motor stator 38 may be press fit into the shell 28. The rotor 40 may be press fit on the driveshaft 42 and may transmit rotational power to the driveshaft 42. The driveshaft 42 may be rotatably supported by a first bearing assembly 44 and a second bearing assembly 46. The driveshaft 42 may include an eccentric crank pin 48 and a lubricant passageway 50. The eccentric pin 48 may be substantially D-shaped, including a flat surface 51. Lubricant may be transmitted through the lubricant passageway 50 from the lubricant sump 36 to various compressor components such as an Oldham coupling 52, the compression mechanism 20, the first bearing assembly 44 and/or the second bearing assembly 46, for example.

The first bearing assembly 44 may be affixed to the shell assembly 16 at a plurality of points in any desirable manner, such as staking. The first bearing assembly 44 may include a bearing housing 47, a bearing 49, and a support ring 53. With additional reference to FIG. 1, the bearing housing 47 may house the bearing 49 therein. The support ring 53 may define a thrust bearing surface 55 on an axial end thereof. The thrust bearing surface 55 may include an annular groove or channel 57 in which an annular seal 59 may be disposed. The annular seal 59 may sealingly separate a first region 65*a* within the bearing housing 47 from a second region 65*b* within the bearing housing 47. The first region 65*a* may be at discharge pressure, and the second region 61*b* may be at an intermediate pressure, less than the discharge pressure.

The compression mechanism 20 may be disposed entirely within the discharge chamber 27 and may include an orbiting scroll 54 and a non-orbiting scroll 56. The orbiting scroll 54 may include an end plate 58 having a spiral wrap 60 extending from a first side 61 thereof. A cylindrical shaft or boss 62 may project downwardly from a second side 63 of the end plate 58. The second side 63 of the end plate 58 and the first bearing assembly 44 may define the first region 65*a*. The first region 65*a* may be a void or space having a height H and a diameter D. The second side 63 of the end plate 58 may be sealingly engaged with the annular seal 59. Relative rotation between the orbiting and non-orbiting scrolls 54, 56 may be prevented by an Oldham coupling 52 engaged with both the orbiting scroll 54 and the non-orbiting scroll 56.

The non-orbiting scroll 56 may include an end plate 64 and a spiral wrap 66 projecting downwardly from the end plate 64. The spiral wrap 66 may meshingly engage the spiral wrap 60 of the orbiting scroll 54, thereby creating a series of moving fluid pockets. The fluid pockets defined by the spiral wraps 60, 66 may decrease in volume as they move from a radially outer position (at a low pressure) to a radially intermediate position (at an intermediate pressure) to a radially inner position (at a high pressure) throughout a compression cycle of the compression mechanism 20. The end plate 64 may include a discharge passage 68 in communication with one of the fluid pockets at the radially inner position and allows compressed working fluid (at the high pressure) to flow into the discharge chamber 27. A discharge valve 70 may provide selective fluid communication between the discharge passage 68 and the discharge chamber 27.

It will be appreciated that the compressor 10 may include some form of capacity modulation, such as mechanical modulation, variable speed and/or vapor injection, for example, to vary the output of the compressor 10.

The unloader assembly 26 may include an unloader counterweight 72 and a bearing assembly 74. The unloader counterweight 72 may include a first longitudinal end 76, a second longitudinal end 78, and a longitudinal opening 80 extending substantially parallel to a rotational axis 82 of the driveshaft 42 between the first longitudinal end 76 and the second longitudinal end 78. The longitudinal opening 80 may be substantially cylindrical and include an inner wall 84. The bearing assembly 74 may be disposed within the longitudinal opening 80 at the second longitudinal end 78 of the unloader counterweight 72. The first longitudinal end 76 of the unloader counterweight 72 may define a substantially planar first end surface 86. The second longitudinal end 78 of the unloader counterweight 72 may define a substantially planar second end surface 88. The first and second end surfaces 86, 88 may be substantially perpendicular to the rotational axis 82.

Figure 3:
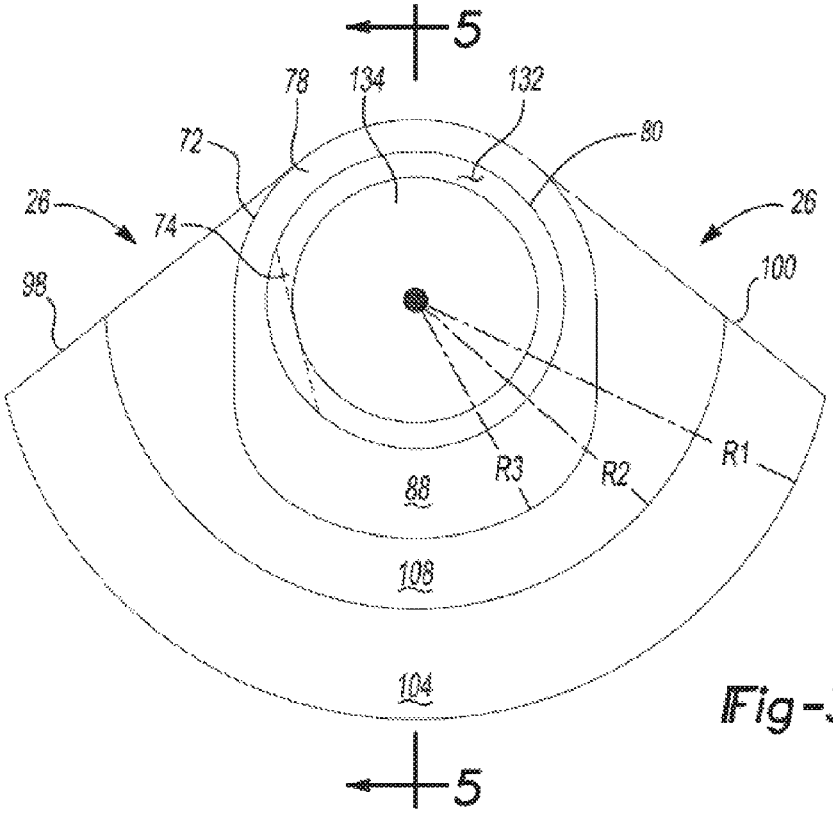
FIG. 3 is a top view of the unloader counterweight of FIG. 2.
Figure 4:
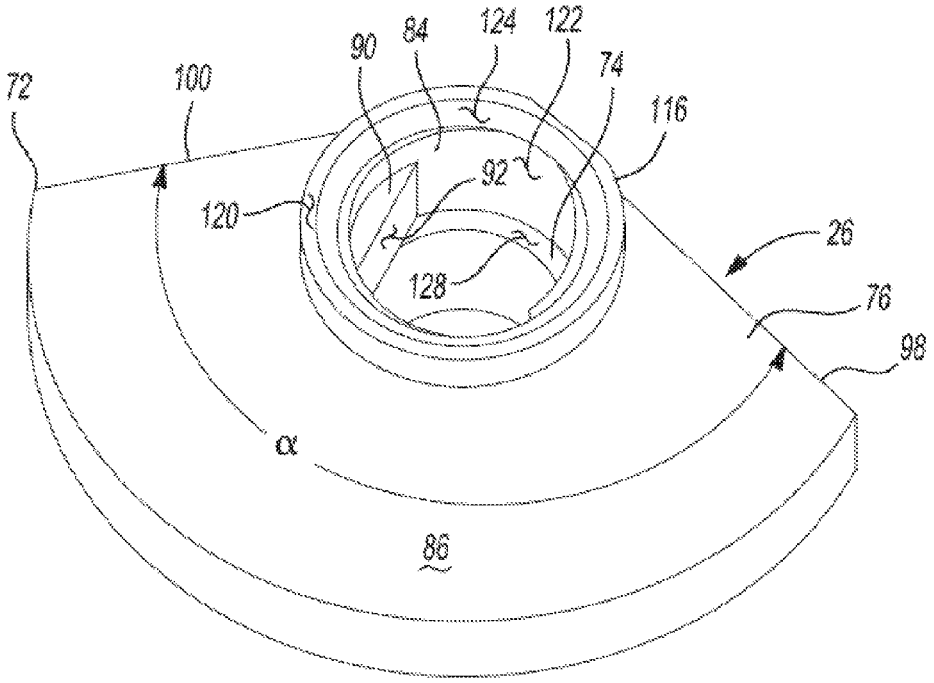
FIG. 4 is a bottom perspective view of the unloader counterweight of FIG. 2.

With reference to FIGS. 3 and 4, a flanged portion 90 may extend from the inner wall 84 of the longitudinal opening 80 and include a flat or planar surface 92. The planar surface 92 may extend across the longitudinal opening 80, such that a portion of the longitudinal opening 80 is substantially D-shaped. The longitudinal opening 80 may receive a portion of the eccentric pin 48. The planar surface 92 of the longitudinal opening 80 may engage the flat surface 51 of the eccentric pin 48, such that the unloader counterweight 72 rotates with the driveshaft 42 about the rotational axis 82.

Figure 2:
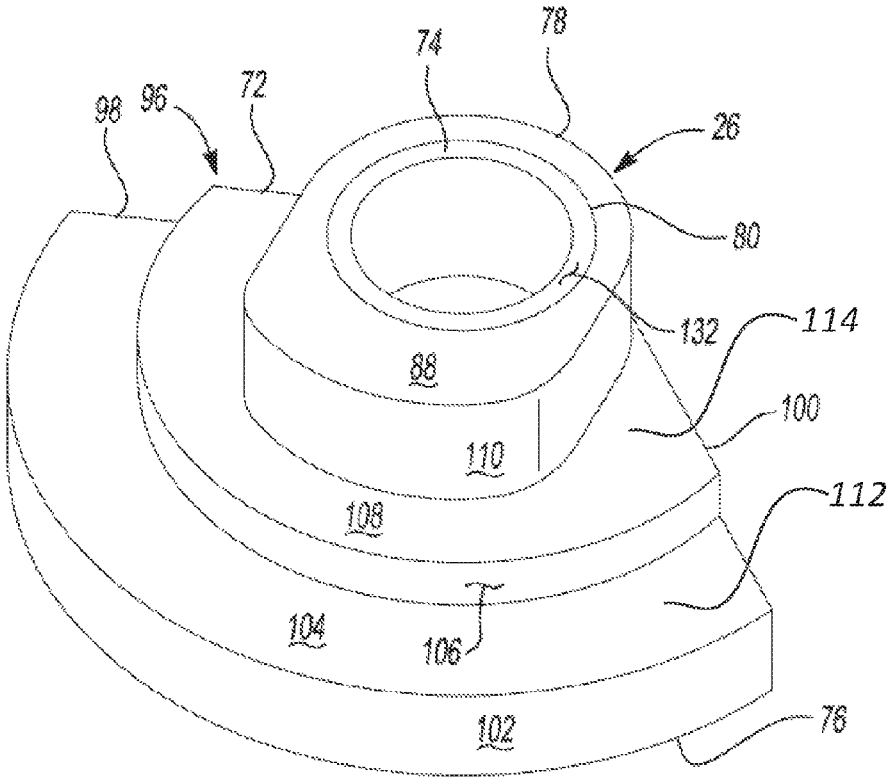
FIG. 2 is a perspective view of an unloader counterweight of the compressor of FIG. 1.

As illustrated in FIG. 2, the unloader counterweight 72 may include a stepped profile 96. The stepped profile 96 may extend longitudinally between the first longitudinal end 76 and the second longitudinal end 78, and extend laterally between a first planar sidewall 98 of the unloader counterweight 72 and a second planar sidewall 100 of the unloader counterweight 72. The first planar sidewall 98 and the second planar sidewall 100 may have an angle $\alpha$ therebetween, defining a substantially wedge-shaped unloader counterweight 72. The angle $\alpha$ may be between 45 degrees and 180 degrees. With reference to FIG. 4, in one configuration, the angle $\alpha$ may be 100 degrees.

Figure 5:
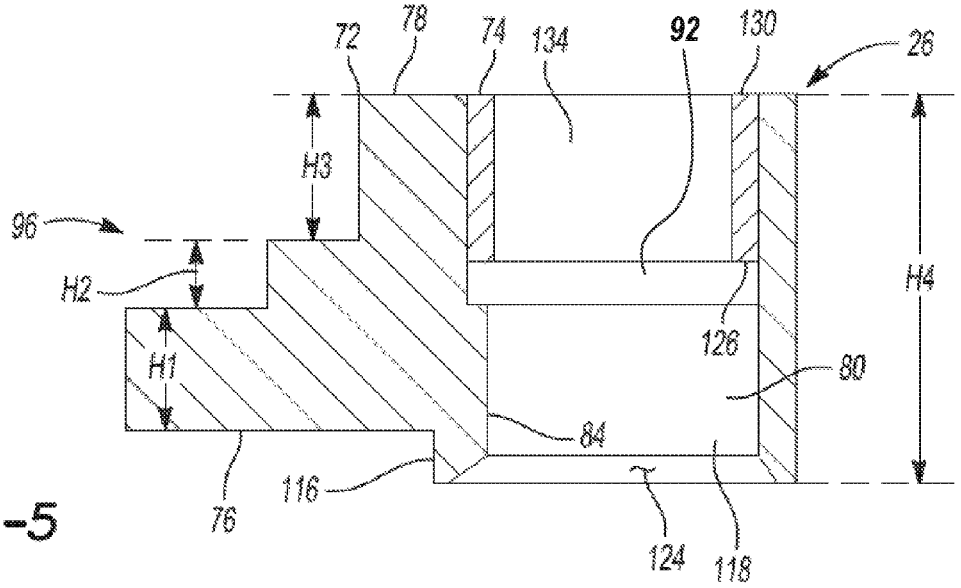
FIG. 5 is a cross-sectional view of the unloader counterweight of FIG. 2, taken through line 5-5 of FIG. 3.

With particular reference to FIGS. 2, 3 and 5, the stepped profile 96 may include a first surface 102, a second surface 104, a third surface 106, a fourth surface 108, and a fifth surface 110. The second surface 104, third surface 106, fourth surface 108, and fifth surface 110 may cooperate to define a first channel 112 and a second channel 114 (FIG. 2). The first surface 102 may be substantially perpendicular to the second surface 104, to the fourth surface 108, and to the first and second end surfaces 86, 88 of the unloader counterweight 72. The first surface 102 may be substantially parallel to the third surface 106 and to the fifth surface 110 of the unloader counterweight 72. The first surface 102 may be substantially arcuate-shaped, have a height H1, and be located a distance R1 from the rotational axis 82. The third surface 106 may be substantially arcuate-shaped, have a height H2, and be located a distance R2 from the rotational axis 82. The fifth surface 110 may be substantially arcuate-shaped, have a height H3, and be located a distance R3 from the rotational axis 82. The ratio of R1 to R2 may be between 2:1 and 2:1.8, and the ratio between H1 and H2 may be between 3:1 and 1:1. In addition, the ratio of R2 to R3 may be between 2:1 and 2:1.8, and the ratio of H2 to H3 may be between 0.4:1 and 1:1. In one configuration, the ratio of R1 to R2 is 2:1.6, the ratio of R2 to R3 is 2:1.6, the ratio of H1 to H2 is 2:1, and the ratio of H2 to H3 is 0.5:1.

The stepped profile 96 of the unloader counterweight 72, and specifically the ratio between (i) R1 and R2, (ii) R2 and R3, (iii) H1 and H2, and (iv) H2 and H3, enables the use of a smaller and more compact unloader assembly 26, having a reduced overall height H4, while optimizing the use of the first region 65*a* between the orbiting scroll 54 and the first bearing assembly 44. For example, the overall height H4 of the unloader assembly 26 may be substantially equal to the height H of the first region 65*a*. In this regard, the height H4 may be between 1 mm and 5 mm less than the height H in order to allow the unloader assembly 26 to rotate within the first region 65*a* about the axis 82. In addition, the distance R1 between the first surface 102 and the rotational axis 82 may be substantially equal to one-half the diameter D of the first region 65*a*. In this regard, the distance R1 may be between 1 mm and 5 mm less than one-half the diameter D in order to allow the unloader assembly 26 to rotate within the first region 65*a* about the axis 82.

With reference to FIG. 4, the first end surface 86 of the unloader counterweight 72 may include a hub portion 116. The hub portion 116 may be substantially cylindrical and include a second longitudinal opening 118, an end surface 120, an inner surface 122, and an annular beveled surface 124. The annular beveled surface 124 may extend between and connect the end surface 120 and the inner surface 122. The second longitudinal opening 118 may have the same diameter as, and be concentrically-aligned with, the longitudinal opening 80 of the unloader counterweight 72. The second longitudinal opening 118 may also receive a portion of the eccentric pin 48, such that the end surface 120 of the hub portion 116 is adjacent to, and engaged with, the driveshaft 42.

The bearing assembly 74 may be rotatably disposed within the longitudinal opening 80 of the unloader counterweight 72, and may include a first longitudinal end 126 defining a first bearing end surface 128 and a second longitudinal end 130 defining a second bearing end surface 132. A third longitudinal opening 134 may extend between the first bearing end surface 128 and the second bearing end surface 132. The third longitudinal opening 134 may rotatably receive the boss 62 of the orbiting scroll 54. Accordingly, the unloader assembly 26 may serve as a coupling mechanism between the driveshaft 42 and the orbiting scroll 54. The flanged portion 90 of the longitudinal opening 80 may axially support the first longitudinal end 126 of the bearing assembly 74.

Operation of the compressor 10 will now be described in detail. As the eccentric pin 48 rotates with the driveshaft 42, thereby causing the unloader counterweight 72 to rotate, the boss 62 of the orbiting scroll 54 may rotate within the bearing assembly 74, such that the orbiting scroll 54 orbits about the rotational axis 82 while the driveshaft 42 and unloader counterweight 72 rotate about the rotational axis 82. Rotation of the unloader counterweight 72 may serve to balance the centrifugally-generated radial forces between the spiral wrap 60 of the orbiting scroll 54 and the spiral wrap 66 of the non-orbiting scroll 56, thereby allowing the orbiting scroll 54 to orbit smoothly relative to the non-orbiting scroll 56 as the speed of the motor assembly 18 varies in a variable-speed scroll compressor.

More specifically, during the operation of the compressor 10, the orbiting scroll 54 may orbit relative to the non-orbiting scroll 56 and generate a centrifugal force. The eccentric pin 48 of the driveshaft 42 may also generate a driving force component which may facilitate radial sealing and radial contact forces between the spiral wrap 60 of the orbiting scroll 54 and the spiral wrap 66 of the non-orbiting scroll 56. Due to the above centrifugal forces and the driving force component, the spiral wrap 60 of the orbiting scroll 54 may abut against the spiral wrap 66 of the non-orbiting scroll 56, thereby ensuring radial sealing between the non-orbiting scroll 56 and the orbiting scroll 54. Since the unloader counterweight 72 may rotate around the boss 62 of the orbiting scroll 54, the counterweight 72 may generate a centrifugal force that offsets and balances the radial contact forces between the non-orbiting scroll 56 and the orbiting scroll 54. This centrifugal force that balances the radial contact forces may be particularly important for operating the compressor 10 in a high speed mode with a radially compliant scroll compressor. The unloader counterweight 72 may dramatically decrease the effect of the radial contact forces that increase as the speed increases, thereby creating less radial contact force at high speeds and thereby improving efficiency and reliability of the compressor 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell;

an orbiting scroll disposed within said shell and including a boss portion;

a driveshaft having an eccentric pin extending from a first end thereof, said driveshaft operable to rotate about a longitudinal axis;

an unloader counterweight assembly having a first end, a second end, and a longitudinal opening extending from said first end to said second end, wherein said eccentric pin is disposed within said longitudinal opening at said first end, and the boss portion of said orbiting scroll is disposed within said longitudinal opening at said second end, and a first planar sidewall, a second planar sidewall, and an arcuate sidewall, wherein said first planar sidewall and said second planar sidewall define an angle therebetween, and wherein said arcuate sidewall traverses said angle and connects the first planar sidewall and the second planar sidewall, the angle being less than 180 degrees such that the first planar sidewall and the second planar sidewall define a wedge-shaped perimeter of the unloader counterweight assembly.

2. The compressor of claim 1, wherein said unloader counterweight assembly includes a bearing assembly disposed within said longitudinal opening, and wherein said boss portion of said orbiting scroll is further disposed within said bearing assembly.

3. The compressor of claim 1, wherein said eccentric pin includes a D shaped cross-section extending from a first end of said driveshaft, and said longitudinal opening includes a D-shaped portion, and wherein the D-shaped cross-section of said eccentric pin is disposed within the D-shaped portion of said longitudinal opening.

4. The compressor of claim 3, wherein said unloader counterweight assembly includes a bearing assembly disposed within said longitudinal opening and axially supported by the D-shaped portion of said longitudinal opening.

5. The compressor of claim 1, wherein said unloader counterweight assembly includes a stepped profile extending from the first end to the second end.

6. The compressor of claim 1, wherein said angle is between 45 degrees and 180 degrees.

7. The compressor of claim 6, wherein said angle is between 100 degrees and 120 degrees.

8. The compressor of claim 1, wherein said arcuate sidewall includes an arcuate surface and at least one channel extending between the first planar sidewall and the second planar sidewall.

9. The compressor of claim 8, wherein said arcuate sidewall includes a first channel and a second channel.

10. The compressor of claim 9, wherein said first channel includes a first surface and a second surface, and said second channel includes a third surface and a fourth surface, and wherein said first surface is substantially parallel to said third surface, and substantially perpendicular to said second surface, to said fourth surface, and to said arcuate surface.

11. The compressor of claim 1, wherein said first end of said unloader counterweight assembly includes a hub portion having an inner surface defining a second longitudinal opening, and wherein said eccentric pin is further disposed within said second longitudinal opening.

12. The compressor of claim 11, wherein said hub portion includes an end surface disposed adjacent the first end of said driveshaft, and an annular beveled surface extending from the end surface to the inner surface.

13. A compressor including an unloader counterweight, said unloader counterweight comprising:

a first end defining a first surface;

a second end defining a second surface, said second surface parallel to said first surface;

a longitudinal opening extending from said first surface to said second surface, said longitudinal opening including at least a substantially flat portion, wherein said unloader counterweight includes a stepped profile extending from the first end to the second end; and a first planar sidewall, a second planar sidewall, and an arcuate sidewall, wherein said first planar sidewall and said second planar sidewall define an angle therebetween, and wherein said arcuate sidewall traverses said angle and connects the first planar sidewall and the second planar sidewall, the angle being less than 180 degrees such that the first planar sidewall and the second planar sidewall define a wedge-shaped perimeter of the unloader counterweight.

14. The compressor of claim 13, wherein said angle is between 45 degrees and 180 degrees.

15. The compressor of claim 14, wherein said angle is between 100 degrees and 120 degrees.

16. The compressor of claim 13, wherein the stepped profile includes a first surface, a second surface, and a third surface, and wherein the first surface is perpendicular to the second surface and parallel to the third surface.

17. The compressor of claim 16, wherein the first surface is located a distance R1 from a rotational axis of the unloader counterweight, and the third surface is located a distance R2 from the rotational axis of the unloader counterweight, the distance R2 being less than the distance R1.

18. The compressor of claim 17, wherein the stepped profile further includes a fourth surface and a fifth surface, and wherein the first surface is perpendicular to the fourth surface and parallel to the fifth surface, the fifth surface located a distance R3 from the rotational axis of the unloader counterweight, the distance R3 being less than the distances R1 and R2.

* * * * *